US010923860B2

(12) United States Patent
Demaratos

(10) Patent No.: US 10,923,860 B2
(45) Date of Patent: Feb. 16, 2021

(54) METHOD FOR SHIELDING AND GROUNDING A CONNECTOR ASSEMBLY FROM ELECTROMAGNETIC INTERFERENCE (EMI) USING CONDUCTIVE SEAL AND CONDUCTIVE HOUSING

(71) Applicant: J.S.T. CORPORATION, Farmington Hills, MI (US)

(72) Inventor: David Demaratos, Wixom, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

(21) Appl. No.: 16/536,123

(22) Filed: Aug. 8, 2019

(65) Prior Publication Data

US 2020/0274297 A1 Aug. 27, 2020

Related U.S. Application Data

(60) Provisional application No. 62/810,107, filed on Feb. 25, 2019.

(51) Int. Cl.

| | |
|---|---|
| ***H01R 13/6581*** | (2011.01) |
| ***H01R 13/6598*** | (2011.01) |
| ***H01R 13/52*** | (2006.01) |
| ***H01R 13/6592*** | (2011.01) |

(52) U.S. Cl.

CPC ..... *H01R 13/6581* (2013.01); *H01R 13/5205* (2013.01); *H01R 13/5216* (2013.01); *H01R 13/6592* (2013.01); *H01R 13/6598* (2013.01)

(58) Field of Classification Search

CPC ..... H01R 13/6851; H01R 13/5205; H01R 13/5216; H01R 13/6598; H01R 13/648; H01R 13/658; H01R 13/6591; H01R 13/6592

USPC ..... 439/607.41

See application file for complete search history.

(56) References Cited

U.S. PATENT DOCUMENTS

| | | | | |
|---|---|---|---|---|
| 4,236,779 | A | 12/1980 | Tang | |
| 4,433,206 | A | 2/1984 | Lewis | |
| 4,531,805 | A * | 7/1985 | Werth | H01R 9/032 439/607.27 |
| 4,684,192 | A * | 8/1987 | Long | H01R 13/629 439/152 |
| 4,886,463 | A * | 12/1989 | Scott | H01R 13/6583 439/89 |
| 4,975,085 | A | 12/1990 | Cartesse | |
| 5,045,635 | A * | 9/1991 | Kaplo | H02B 1/16 174/354 |

(Continued)

OTHER PUBLICATIONS

Demaratos, David; U.S. Appl. No. 16/447,731, filed Jun. 20, 2019.

(Continued)

*Primary Examiner* — Peter G Leigh

(74) *Attorney, Agent, or Firm* — Kratz, Quintos & Hanson, LLP

(57) ABSTRACT

A connector assembly for connecting to a device which, when in operation, experiences reduced or suppressed EMI. The EMI flow path, generated by, e.g., at least a battery cable assembly or the like, housed within at least a male connector assembly or a female connector assembly, is conducted through at least an electrically conductive housing and an electrically conductive seal.

17 Claims, 6 Drawing Sheets

(56) References Cited

U.S. PATENT DOCUMENTS 5,326,947 A 7/1994 Edds
5,531,614 A 7/1996 Gallusser
6,083,014 A 7/2000 Bogdan
6,554,623 B2 * 4/2003 Yoshioka ..... H01R 13/6592 439/98
6,595,801 B1 7/2003 Leonard
6,680,433 B2 * 1/2004 Hashizawa ..... H01R 13/521 174/359
6,815,610 B2 * 11/2004 Kuboshima ..... H01R 13/5845 174/360
6,921,292 B2 7/2005 Miyazaki
7,097,499 B1 * 8/2006 Purdy ..... H01R 9/0521 439/578
7,104,822 B2 9/2006 Jazowski
7,165,995 B2 1/2007 Fukushima
7,182,612 B1 2/2007 Immethun
7,613,003 B2 * 11/2009 Pavlovic ..... B60L 3/0069 361/709
7,614,910 B2 11/2009 Croteau
7,632,148 B1 * 12/2009 Kawamura ..... H01R 13/5221 439/607.41
7,811,105 B1 10/2010 Tan Chin Yaw
8,157,589 B2 * 4/2012 Krenceski ..... H01R 13/622 439/578
8,167,635 B1 * 5/2012 Mathews ..... H01R 13/5205 439/277
8,262,413 B2 9/2012 Fujiwara
8,382,517 B2 * 2/2013 Mathews ..... H01R 24/40 439/578
8,747,157 B2 * 6/2014 Tashiro ..... H01R 9/16 439/595
8,876,550 B1 * 11/2014 Krenceski ..... H01R 13/6596 439/578
8,986,045 B2 3/2015 Okamoto
8,992,249 B2 3/2015 Kobayashi
9,039,450 B2 * 5/2015 Germ ..... H01R 13/5205 439/607.41
9,040,846 B2 5/2015 Suzuki
9,252,509 B2 2/2016 Kato
9,337,577 B1 5/2016 Hitchcock
9,431,727 B2 * 8/2016 Kato ..... H01R 9/05
9,431,771 B1 8/2016 Sundarakrishnamachari et al.
9,496,656 B2 * 11/2016 Hsu ..... H01R 12/724
9,640,965 B1 5/2017 Long
9,716,374 B2 7/2017 Rohr
9,948,038 B2 4/2018 Katou
2002/0031949 A1 3/2002 Miyazaki
2002/0042228 A1 * 4/2002 Yoshioka ..... H01R 13/6592 439/98
2002/0048994 A1 4/2002 Oota
2002/0098737 A1 7/2002 Koide
2003/0008555 A1 * 1/2003 Obata ..... H01R 13/6582 439/578
2004/0057187 A1 3/2004 Kuboshima
2004/0106325 A1 6/2004 Miyazaki
2004/0235351 A1 11/2004 Aisenbrey
2005/0215122 A1 9/2005 Nishida
2007/0149008 A1 * 6/2007 Pabst ..... H01R 12/774 439/95
2007/0270037 A1 11/2007 Deterre
2009/0124121 A1 5/2009 Matsuoka
2009/0149048 A1 * 6/2009 Pavlovic ..... B60L 3/0069 439/181
2009/0181571 A1 7/2009 Willing
2010/0261364 A1 10/2010 Matsuoka
2010/0279555 A1 11/2010 Azad
2012/0021632 A1 1/2012 Matsumoto
2012/0155988 A1 6/2012 Schumacher
2012/0252272 A1 10/2012 Omae
2013/0017719 A1 1/2013 Tanaka
2013/0078872 A1 * 3/2013 Tashiro ..... H01R 13/4223 439/695
2014/0011401 A1 1/2014 Endo
2014/0038459 A1 2/2014 Kobayashi
2014/0127063 A1 5/2014 Itsuki
2014/0287631 A1 9/2014 Tashiro
2014/0370753 A1 12/2014 Kobayashi
2015/0050826 A1 2/2015 Tashiro
2015/0079859 A1 3/2015 Glick
2015/0087190 A1 3/2015 Schwan
2015/0270650 A1 9/2015 Bower
2015/0280381 A1 10/2015 Rangi
2016/0134049 A1 5/2016 Kataoka
2016/0172784 A1 6/2016 Kataoka
2016/0181736 A1 6/2016 Hsu
2016/0233625 A1 8/2016 Kato
2016/0329651 A1 11/2016 Yamaguchi
2016/0329661 A1 11/2016 Fischer
2017/0303446 A1 10/2017 Johansson
2017/0338600 A1 11/2017 Tanaka
2018/0034200 A1 2/2018 Rhein

OTHER PUBLICATIONS

Azad, Vikas; U.S. Appl. No. 16/504,288, filed Jul. 7, 2019.
Azad, Vikas; U.S. Appl. No. 16/504,287, filed Jul. 7, 2019.
Demaratos, David; U.S. Appl. No. 16/583,915, filed Sep. 26, 2019.
Azad, Vikas; U.S. Appl. No. 16/370,069, filed Mar. 29, 2019.
Azad, Vikas; U.S. Appl. No. 16/369,943, filed Mar. 29, 2019.
Written Opinion of the International Searching Authority for International Application No. PCT/US2019/062861 dated Jan. 14, 2020 (8 sheets).
International Search Report for International Application No. PCT/US2019/062861 dated Jan. 14, 2020 (3 sheets).
International Search Report for International Application No. PCT/US19/42437 dated Oct. 21, 2019 (3 sheets).
Written Opinion of the International Searching Authority for International Application No. PCT/US19/42437 dated Oct. 21, 2019 (6 sheets).
International Search Report for International Application No. PCT/US19/63068 dated Feb. 11, 2020 (4 sheets).
Written Opinion of the International Searching Authority for International Application No. PCT/US19/63068 dated Feb. 11, 2020 (9 sheets).
International Search Report for International Application No. PCT/US19/45971 dated Feb. 6, 2020 (3 sheets).
Written Opinion of the International Searching Authority for International Application No. PCT/US19/45971 dated Feb. 6, 2020 (6 sheets).
Office Action of U.S. Appl. No. 16/369,943 dated Jan. 22, 2020.
Office Action of U.S. Appl. No. 16/370,069 dated Dec. 3, 2019.
Office Action of U.S. Appl. No. 161447,731 dated Feb. 6, 2020.
Office Action of U.S. Appl. No. 16/370,069 dated Apr. 4, 2020.
Written Opinion of the International Searching Authority for International Application No. PCT/US2020/015929 dated Apr. 20, 2020 (6 sheets).
International Search Report for International Application No. PCT/US2020/015929 dated Apr. 20, 2020 (2 sheets).
International Preliminary Report on Patentability for International Application No. PCT/US2019/062861 dated Apr. 21, 2020 (12 sheets).

* cited by examiner

FIG. 1 RELEVANT ART

RELEVANT ART

RELEVANT ART

METHOD FOR SHIELDING AND GROUNDING A CONNECTOR ASSEMBLY FROM ELECTROMAGNETIC INTERFERENCE (EMI) USING CONDUCTIVE SEAL AND CONDUCTIVE HOUSING

CROSS-REFERENCE TO RELATED APPLICATION

This patent application claims priority to U.S. Provisional Patent Application No. 62/810,107 filed Feb. 25, 2019, which is hereby incorporated herein by reference in its entirety.

BACKGROUND OF THE INVENTION

It is desired that a connector assembly (preferably a high voltage connector assembly) experiences a reduced or suppressed electromagnetic interference (EMI).

Shown in FIGS. 1 and 2 are a conventional connector assembly, generally referred to as reference number 1, which employs stamped shields for EMI shielding or containment. The conventional assembly 1 includes a female connector assembly 20 and a male connector assembly 25 joined together. Respectively contained within the female connector assembly 20 and the male connector assembly 25 are battery cable assemblies 28, 30. Surrounding the battery cable assembly 28 housed within the female connector assembly 20 is a corresponding female wire shield 5 secured therearound by a corresponding ferrule 8, the ferrule 8 being housed and contacting a female inner housing 10. A female stamped shield 13 surrounds, in part, the female inner housing 10, while the female stamped shield 13 is surrounded by a female outer housing 15. The female stamped shield 13 extends towards and connects with an intermediate stamp shield 28, which in turn connects with a male stamped shield 32. The male stamped shield 32 extends between a male inner housing 35 and a male outer housing 40, the male inner housing 35 contacting and surrounding, in part, a ferrule 44, which in turn contacts and surrounds a corresponding male wire shield 48.

Moreover, the conventional connector assembly 1, illustrated in FIG. 1, has a female terminal position assurance (TPA) device 50 and a male terminal position assurance (TPA) device 55 inserted into the female connector assembly 20 and the male connector assembly 25, respectively, for securing respective terminals therein. Plastic back covers 58, 60 are secured at respective ends of the female and male connector assemblies 20, 25. Near the plastic back cover 58 of the female connector assembly 20 is a silicone wire seal 63, while near the plastic back cover 60 of the male connector assembly 25 is a silicone wire seal 65. The junction between the female outer housing 15 and the male outer housing 40 is sealed by a silicone ring seal 70.

In the conventional connector assembly 1, the associated female inner housing 10, female outer housing 15, male inner housing 35, and male outer housing 40 are made of plastic, resin, nylon, or a non-conductive material. Similarly, in the conventional connector assembly 1, the associated seals (including the silicone wire seal 63 in the female connector assembly 20, the silicone wire seal 65 in the male connector assembly 25, and silicone ring seal 70 at the junction between the female and male connector assemblies 20, 25) are made of non-conductive materials.

Due to the conventional non-conductive resin, nylon or plastic-made female inner and outer housings 10, 15 of the female connector assembly 20, the conventional non-conductive resin, nylon or plastic-made male inner and outer housings 35, 40 of the male connector assembly 25, and the non-conductive silicone seals 63, 65, 70, the EMI generated in the conventional connector assembly 1, which employs the female stamped shield 13, intermediate stamp shield 28, and male stamped shield 32, has limited EMI grounding path, as further discussed below with respect to FIGS. 2 and 3.

As shown in FIGS. 2 and 3, the EMI, generated by, for example, the conducting battery cable assembly 28 (housed within the female connector assembly 20) and the conducting battery cable assembly 30 housed within the male connector assembly 25, have flow paths 80, 88 that travel within the conventional connector assembly 1 between the female wire shield 5 and the male wire shield 48. More particularly, the EMI generated in the conventional connector assembly 1 travels between the female wire shield 5 and the male wire shield 48 through the respective female wire shield 5 and the adjoining ferrule 8, the female stamped shield 13, the male stamped shield 32, the adjoining ferrule 44, and the respective male wire shield 48.

SUMMARY OF THE INVENTION

This invention provides such a high voltage connector assembly for connecting to a device which, when in operation, experiences reduced or suppressed EMI. The EMI flow path, generated by, e.g., a battery cable assembly or the like, housed within a male connector assembly, is conducted, although not limited thereto, to, for example, a male wire shielding, a male electrically conducting seal, a male electrically conducting outer housing, an electrically conducting interface seal, a female electrically conducting outer housing, a female electrically conducting seal, and ultimately to a female wire shielding. Additionally, the EMI flow path, generated by, e.g., another cable assembly or the like at an opposite end of the connector assembly within a female connector assembly is, although not limited thereto, conducted to, for example, the female wire shielding, the female electrically conducting seal, the female electrically conducting outer housing, the electrically conducting interface seal, the male electrically conducting outer housing, the male electrically conducting seal, and ultimately to the male wire shielding.

DETAILED DESCRIPTION OF THE PREFERRED EMBODIMENTS

Figure 1:
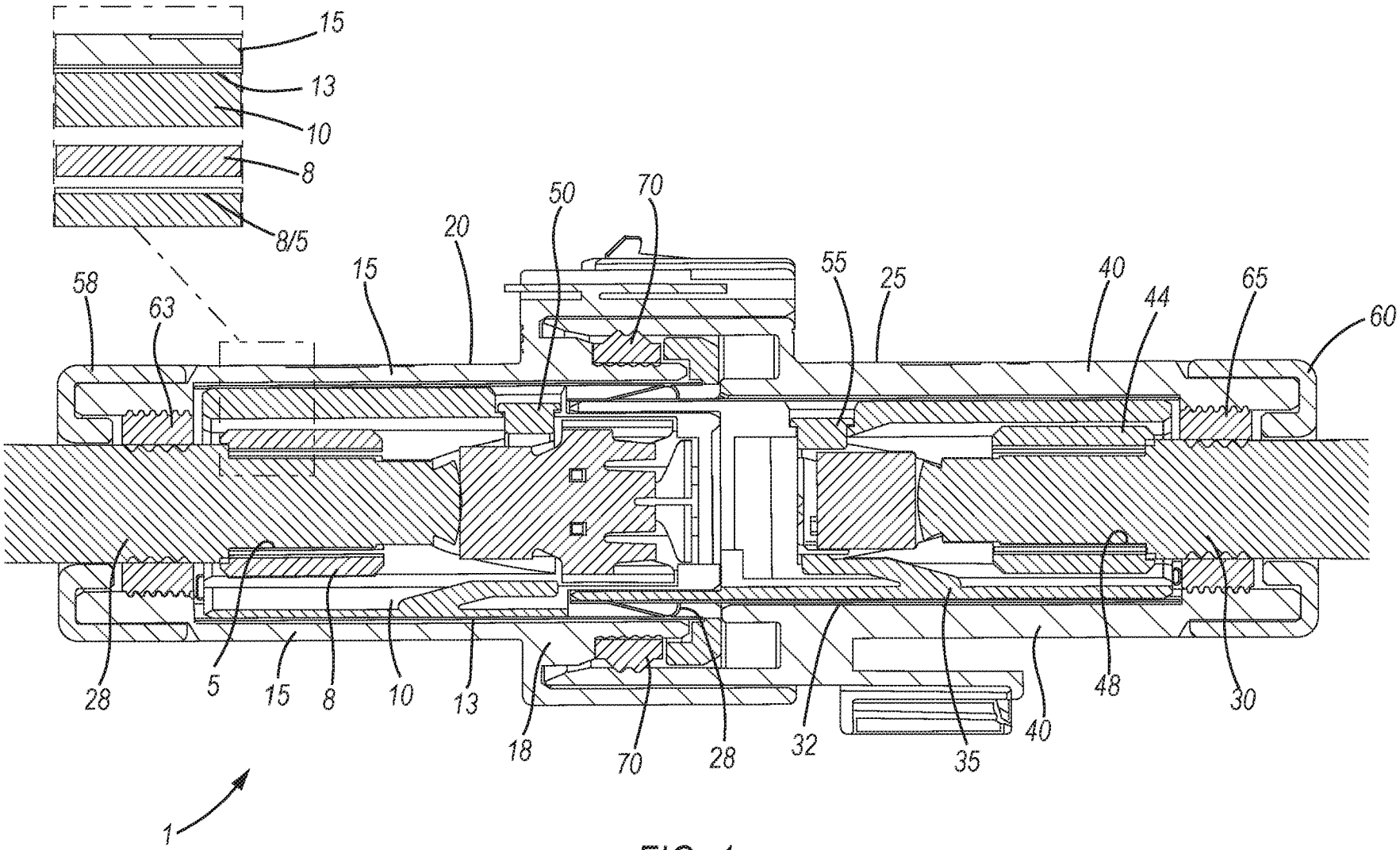
FIG. 1 is a conventional connector assembly having a male connector assembly and a female connector assembly, which uses a stamped shield.
Figure 2:
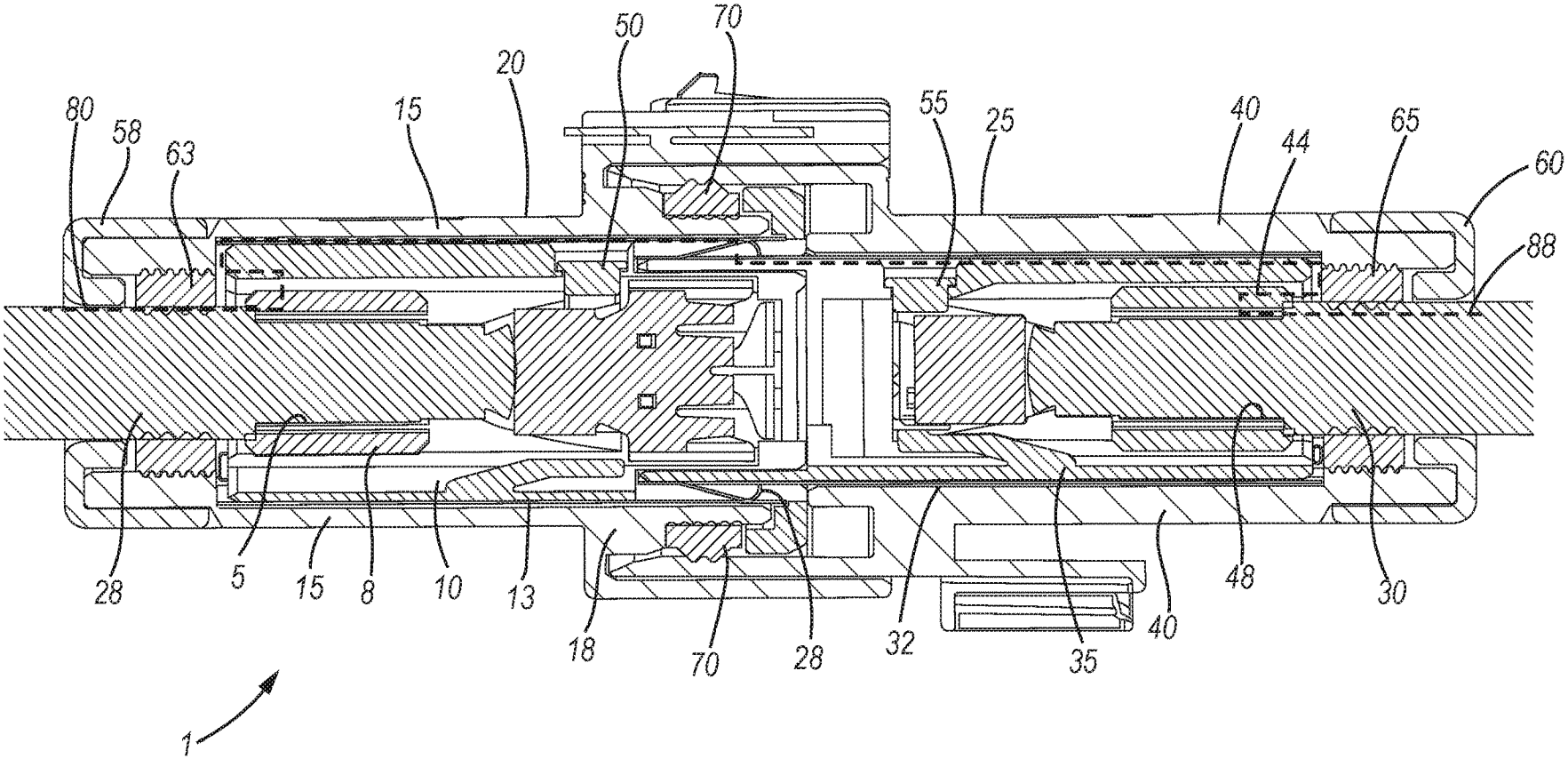
FIG. 2 shows an EMI path in the conventional connector assembly, which uses the stamped shield for EMI containment.
Figure 3:
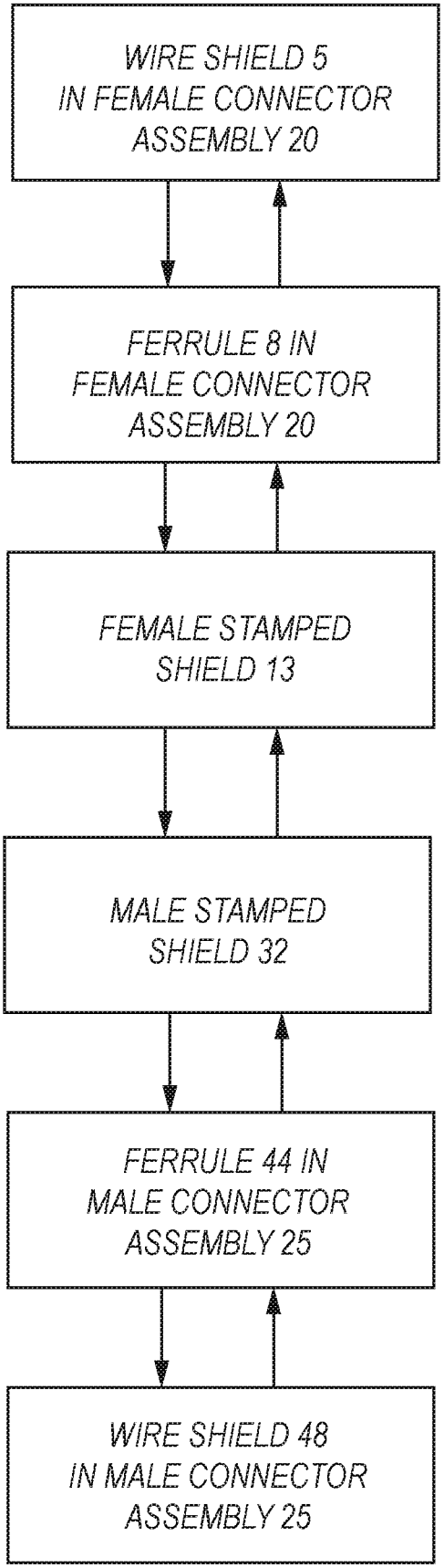
FIG. 3 is a flowchart of at least a flow path of the EMI flowing through the conventional connector assembly.
Figure 4:
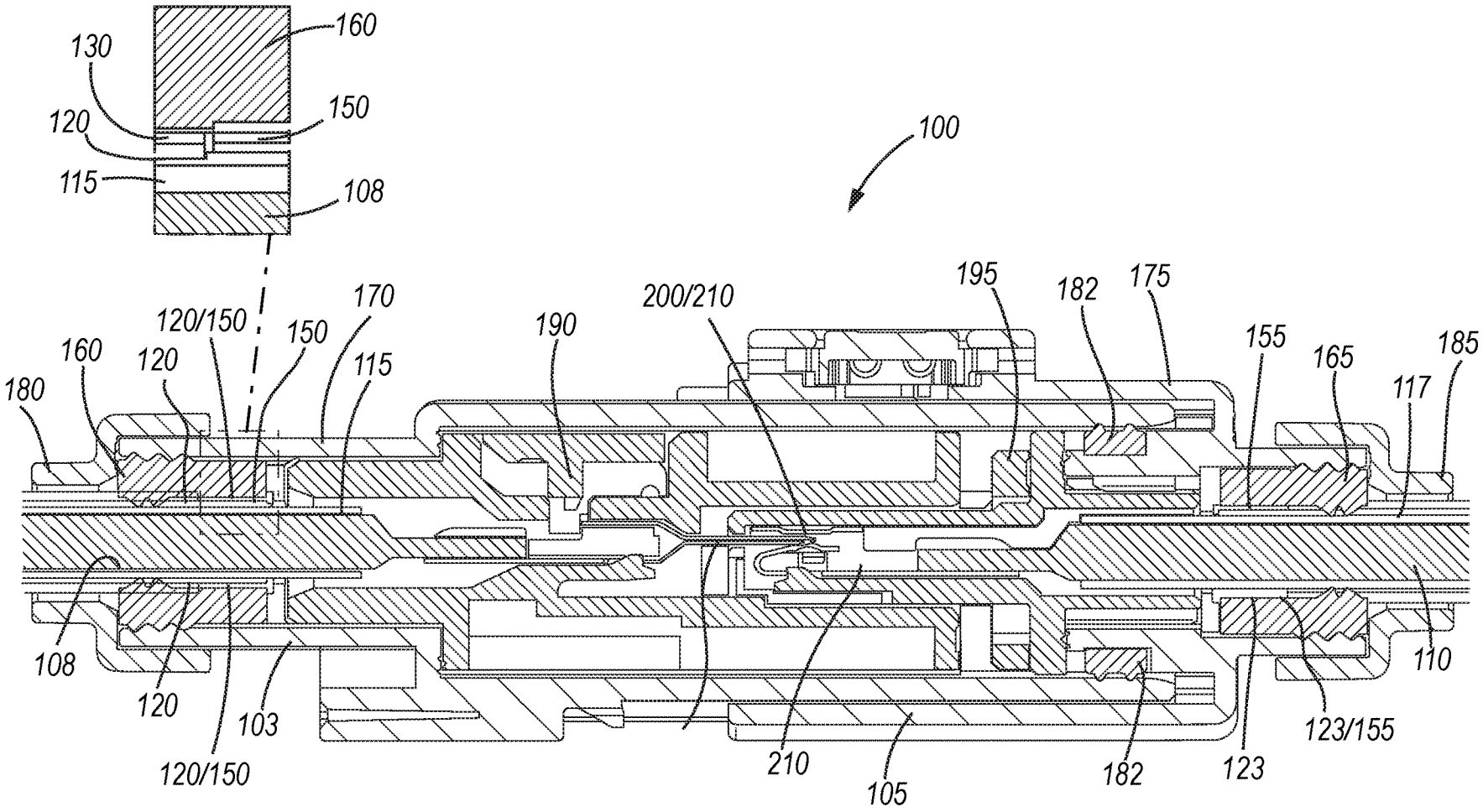
FIG. 4 is a structural arrangement of a connector assembly having a male connector and a female connector, which illustrates the shielding and grounding of a connector assembly from the EMI using at least a conductive seal and a conductive housing.

Illustrated in FIG. 4 is a first embodiment of the connector assembly of this invention, and is generally referred to as reference number 100. The connector assembly 100 of this invention is preferably a high voltage connector assembly having a male connector assembly 103 and a female connector assembly 105. The male connector assembly 103 houses a battery cable assembly 108; and on an opposite side of the connector assembly 100, the female connector assembly 105 houses another battery cable assembly 110. Surrounding the battery cable assembly 108 is an inner wire insulation 115, while the another battery cable assembly 110 is surrounded by another wire insulation 117.

In the male connector assembly 103, a wire shielding 120 surrounds the inner wire insulation 115; and while in the female connector assembly 105, a wire shielding 123 surrounds the another inner wire insulation 117. Outside the wire shielding 120, near an end portion of the male connector assembly 103, is an outer wire insulation 130. Outside the wire shielding 123, near an end portion of the female connector assembly 105, is an outer wire insulation 132. The wire shielding 120 in the male connector assembly 103, in another portion thereof, may contact a ferrule 150 (i.e., a wire shielding 120/ferrule 150 interface). At the other end of the connector assembly 100, in the female connector assembly 105, the wire shielding 123, in another portion thereof, may contact a ferrule 155 (i.e., a wire shielding 123/ferrule 155 interface). The ferrules 150, 155 are preferably metallic, conductive material, or the like.

As further illustrated in FIG. 4, an electrically conductive seal 160 surrounds the wire shielding 120 and the ferrule 150 (i.e., surrounds the wire shielding 120/ferrule 150 interface) of the male connector assembly 103. As also shown in FIG. 4, an electrically conductive seal 165 surrounds the wire shielding 123 and the ferrule 155 (i.e., surrounds the wire shielding 123 and the ferrule 155 (i.e., surround the wire shielding 123/ferrule 155 interface) of the female connector assembly 105. In the male connector assembly 103, the electrically conductive seal 160 is positioned between the wire shielding 120/ferrule 150 interface and a conductive male outer housing 170. In the female connector assembly 105, the electrically conductive seal 165 is positioned between the wire shielding 123/ferrule 155 interface and a conductive female outer housing 175.

At an end portion of the male connector assembly 103, a plastic back cover 180 shields the electrically conductive seal 160 and an end portion of the male outer housing 170. At an end portion of the female connector assembly 105, a plastic back cover 185 shields the electrically conductive seal 165 and an end portion of the female outer housing 175.

The interface between the male outer housing 170 and the female outer housing 175 is sealed with an electrically conductive interface seal 182 (in the form or shape of a ring or the like).

Each of the electrically conductive seal 160 of the male connector assembly 103, the electrically conductive seal 165 of the female connector assembly 105, and the electrically conductive interface seal 182 is made of an electrically conductive metal-infused silicone, a conductive metal-filled silicone or the like, the metal being, e.g., stainless steel or the like.

Each of the male outer housing 170 of the male connector assembly 103 and the female outer housing 175 of the female connector assembly 105 is made of a conductive metal-infused material, a conductive metal-filled material or the like, the material being plastic, resin, nylon, or the like. The conductive metal in the metal-infused material or metal-filled material of the male outer housing 170 or the female outer housing 175 is, e.g., stainless steel or the like. An example of the conductive metal-infused material or conductive metal-filled material of the male electrically conductive outer housing 170 or the female electrically conductive outer housing 175 is a stainless steel-filled resin or stainless steel-infused resin made by RTP Corp.

Generally contained within the male outer housing 170 and the female outer housing 175 are a male terminal position assurance (TPA) device 190, a female terminal position assurance (TPA) device 195, and a male terminal 200/female terminal 210 interface respectively extending from the battery cable assembly 108 of the male connector assembly 103 and the battery cable assembly 110 of the female connector assembly 105.

The method for shielding and grounding the connector assembly 100 of this invention from electromagnetic interference (EMI) is hereinafter described and illustrated in FIGS. 5 and 6. The EMI flow paths 300, 320, although each shown as a single multiple dashed lines in FIG. 5 for illustration purposes only, travel all throughout the connector assembly 100 through the various elements of the connector assembly 100, including through the male electrically conducting seal 160, the male electrically conducting outer housing 170, the electrically conducting interface seal 182, the female electrically conducting outer housing 175, and the female electrically conducting seal 165, although not limited thereto.

Figure 5:
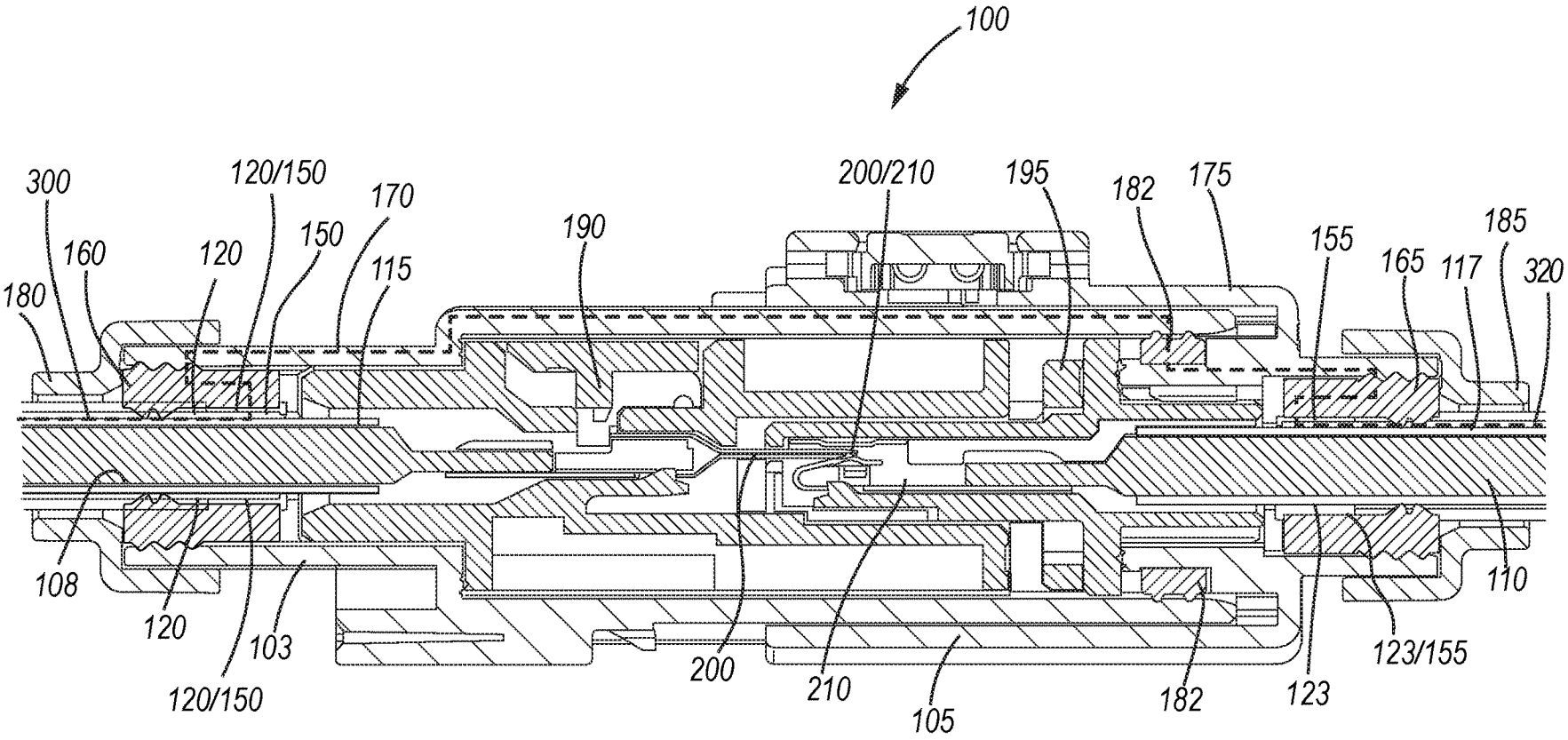
FIG. 5 shows a shielding and grounding EMI path of this invention in the connector assembly of FIG. 4, which uses at least a conductive seal and a conductive housing.
Figure 6:
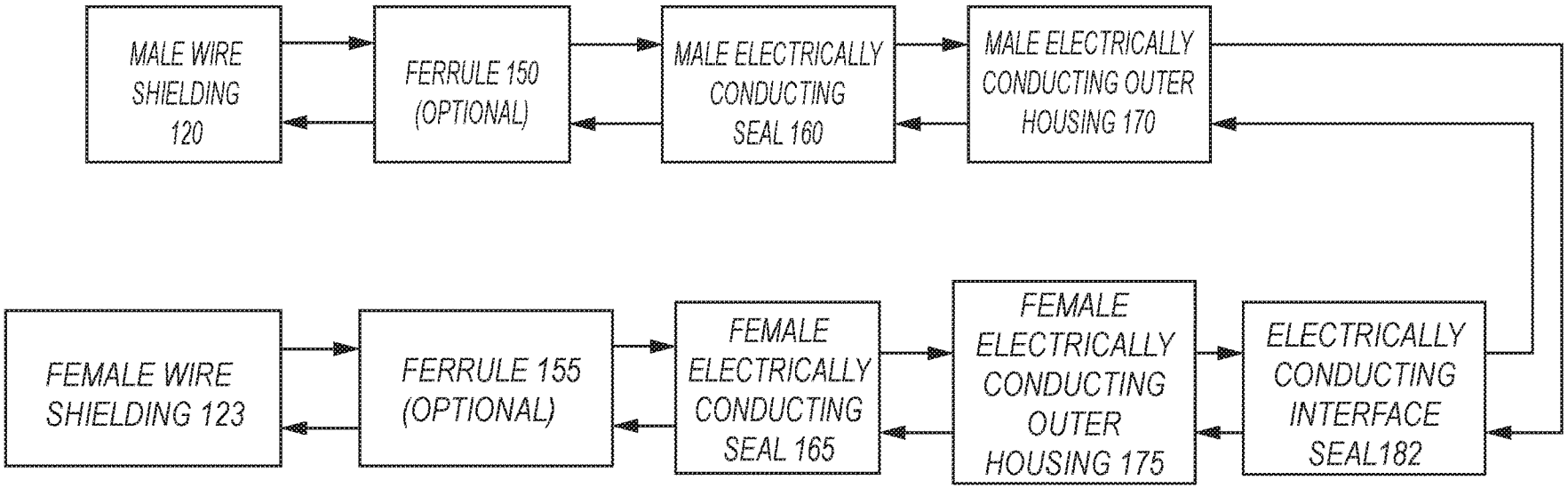
FIG. 6 is a flowchart of at least a flow path of the EMI of this invention flowing through the connector assembly, with the use of at least a conductive seal and a conductive housing, shown in FIGS. 4 and 5 for EMI shielding and grounding.

As illustrated in FIGS. 5 and 6, the EMI generated from, for example, the high voltage battery cable assembly 108 of the male connector assembly 103, has a flow path 300 that is conducted to the male wire shielding 120 and to the adjoining ferrule 150 (made of metal) through the male electrically conducting seal 160 (made of, e.g., stainless steel or the like fiber-filled or fiber-infused silicone or the like). The EMI is then further conducted through the male electrically conducting outer housing 170 and through the electrically conducting interface seal 182 (in the form of, e.g., a ring or the like). As discussed earlier, the electrically conducting interface seal 182 seals the interface between the male outer housing 170 and the female outer housing 175. After the EMI passes through the electrically conducting interface seal 182, the EMI is further conducted through the female electrically conducting outer housing 175, the female electrically conducting seal 165, the adjoining ferrule 155 (made of metal), and then to the female wire shielding 123.

In the another embodiment of the above-described invention, the ferrule 150 in the male wire shielding 120/ferrule 150 interface of the male connector assembly 103 and the ferrule 155 of the female wire shielding 123/ferrule 155 interface of the female connector assembly 105 may be deleted and are optional components. In such a case, the EMI flow path 300 passes through the male wire shielding 120 and directly to the male electrically conducting seal 160. Also in such a case, the EMI flow path 300 passes through the female electrically conducting seal 165 and directly to the female wire shielding 123.

The method for shielding and grounding the connector assembly 100 of this invention from EMI is further described in relation to FIGS. 5 and 6. Here, the EMI generated from, for example, the high voltage battery cable assembly 110 or the like of the female connector assembly 105 has a flow path 320 that is conducted to the female wire shielding 123 and to the adjoining ferrule 155 (made of metal) through the female electrically conducting seal 165 (made of, e.g., stainless steel or the like fiber-filled or fiber-infused silicone or the like). The EMI is then further conducted through the female electrically conducting outer housing 175 and through the electrically conducting interface seal 182, which as discussed earlier may be in the form of a ring or the like and seals the interface between the female electrically conducting outer housing 175 and the male electrically conducting outer housing 170. After the EMI passes through the electrically conducting interface seal 182, the EMI is further conducted through the male electrically conducting outer housing 170 and through the male electrically conducting seal 160 of the male connector assembly 103, and through the adjoining ferrule 150, and ultimately to the male wire shielding 120.

In another embodiment of the invention, the ferrule 155 of the female wire shielding 123/ferrule 155 interface of the female connector assembly 105, and the ferrule 150 of the male wire shielding 120/ferrule 150 interface of the male connector assembly 103 may be deleted and are optional components. In such a case, the EMI flow path 320 passes through the female wire shielding 123 and directly to the female electrically conducting seal 165. Also in such a case, the EMI flow path 32 passes through the male electrically conducting seal 160 and directly to the male wire shielding 120.

Although the foregoing descriptions are directed to the preferred embodiments of the invention, it is noted that other variations and modifications will be apparent to those skilled in the art, and may be made without departing from the spirit or scope of the invention. Moreover, structures, structural arrangements, or features described in connection with one embodiment of the invention may be used in conjunction with other embodiments, even if not explicitly stated above.

I claim:

1. A method for shielding and grounding a connector assembly from electromagnetic interference (EMI), comprising at least one of:

(a) a step of directing said EMI to a male electrically conducting seal, and a female electrically conducting seal; and (b) a step of directing said EMI to a male electrically conducting housing that houses said male electrically conducting seal, and a female electrically conducting housing that houses said female electrically conducting seal.

2. The method for shielding and grounding said connector assembly from said EMI according to claim 1, wherein said step of directing said EMI to said at least an electrically conducting housing comprises at least one of:

(i) a step of directing said EMI to a male electrically conducting housing, and (ii) a step of directing said EMI to a female electrically conducting housing.

3. The method for shielding and grounding said connector assembly from said EMI according to claim 2, wherein at least one of said male electrically conducting housing and said female electrically conducting housing is an outer housing.

4. The method for shielding and grounding said connector assembly from said EMI according to claim 1, wherein said electrically conducting seal is a metal-infused or metal-filled material, and wherein said material is material selected from the group consisting of silicone.

5. The method for shielding and grounding said connector assembly from said EMI according to claim 4, wherein said metal-infused or metal-filled material of said electrically conducting seal is comprised of a metal, and wherein said metal is a conductive metal selected from the group consisting of stainless steel.

6. The method for shielding and grounding said connector assembly from said EMI according to claim 1, wherein said electrically conducting housing is made of a metal-infused or metal-filled material, and wherein the material is selected from the group consisting of resin, plastic, nylon.

7. The method for shielding and grounding said connector assembly from said EMI according to claim 6, wherein said metal-infused or metal-filled electrically conducting housing is comprised of metal, and wherein said metal is a conductive metal selected from the group consisting of stainless steel.

8. The method for shielding and grounding said connector assembly from said EMI according to claim 1, wherein said step of directing said EMI to said male electrically conducting housing and said female electrically conducting housing includes a step of further directing said EMI to an electrically conducting interface seal.

9. A method for shielding and grounding a connector assembly from electromagnetic interference (EMI) using at least a conductive seal and a conductive housing, comprising the steps of:

directing said EMI, generated within a male connector assembly of said connector assembly, into a male wire shielding;

directing said EMI to a male electrically conducting seal;

directing said EMI to a male electrically conducting outer housing;

directing said EMI to an electrically conducting interface seal;

directing said EMI to a female electrically conducting outer housing; said electrically conducting interface seal sealing an interface between said male electrically conducting outer housing and said female electrically conducting outer housing;

directing said EMI to a female electrically conducting seal; and thereafter directing said EMI to a female wire shielding.

10. The method for shielding and grounding said connector assembly from said EMI according to claim 9, further comprising:

directing said EMI, generated by at least a battery cable assembly within said female connector assembly of said connector assembly, into a female ti wire shielding;

directing said EMI to said female electrically conducting seal;

directing said EMI to said female electrically conducting outer housing;

directing said EMI to said electrically conducting interface seal;

directing said EMI to said male electrically conducting outer housing;

directing said EMI to said male electrically conducting seal; and thereafter directing said EMI to said male wire shielding.

11. The method for shielding and grounding said connector assembly from said EMI according to claim 10, wherein said step of directing said EMI to said female electrically conducting seal includes the step of directing said EMI to a female wire shielding/ferrule interface; and wherein said step of directing said EMI to said male wire shielding includes the step of directing said EMI to a male wire shielding/ferrule interface.

12. The method for shielding and grounding said connector assembly from said EMI according to claim 9, wherein said step of directing said EMI to said male electrically conducting seal includes the step of directing said EMI to a male wire shielding/ferrule interface; and wherein said step of directing said EMI to said female wire shielding includes the step of directing said EMI to a female wire shielding/ferrule interface.

13. The method for shielding and grounding said connector assembly from said EMI according to claim 9, wherein at least one of said male electrically conducting seal, said electrically conducting interface seal, and said female electrically conducting seal is a metal-infused or metal-filled material, and wherein said material is material selected from the group consisting of silicone.

14. The method for shielding and grounding said connector assembly from said EMI according to claim 13, wherein said metal-infused or metal-filled material of at least one of said male electrically conducting seal, said electrically conducting interface seal, and said female electrically conducting seal is comprised of metal, and wherein said metal is a conductive metal selected from the group consisting of stainless steel.

15. The method for shielding and grounding said connector assembly from said EMI according to claim 9, wherein at least one of said male electrically conducting housing and said female electrically conducting housing is made of a metal-infused or metal-filled material, and wherein said material is selected from the group consisting of resin, plastic, nylon.

16. The method for shielding and grounding said connector assembly from said EMI according to claim 15, wherein said metal-infused or metal-filled electrically conducting housing is comprised of metal, and wherein said metal is a conductive metal selected from the group consisting of stainless steel.

17. The method for shielding and grounding a connector assembly from said EMI according to claim 9, wherein said EMI is generated by at least a battery cable assembly.

* * * * *